US009140182B2

(12) United States Patent
Woo et al.

(10) Patent No.: US 9,140,182 B2
(45) Date of Patent: Sep. 22, 2015

(54) VARIABLE COMPRESSION RATIO CONTROL SYSTEM

(71) Applicant: Hyundai Motor Company, Seoul (KR)

(72) Inventors: Yoonsik Woo, Yongin-Si (KR); Jin Kook Kong, Suwon-si (KR); Ju Hun Lee, Gwangmyung-si (KR); Eun Ho Lee, Suwon-si (KR); Dong Seok Lee, Suwon-si (KR); Soo Hyung Woo, Yongin-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 105 days.

(21) Appl. No.: 14/098,533

(22) Filed: Dec. 6, 2013

(65) Prior Publication Data

US 2014/0238356 A1 Aug. 28, 2014

(30) Foreign Application Priority Data

Feb. 22, 2013 (KR) ..... 10-2013-0019432

(51) Int. Cl.
*F01L 1/34* (2006.01)
*F02B 75/04* (2006.01)

(52) U.S. Cl.
CPC ..... *F02B 75/04* (2013.01); *F02B 75/045* (2013.01)

(58) Field of Classification Search
CPC ..... F02B 75/04; F02B 75/045; F02B 75/32
USPC ..... 123/48 B, 78 E, 78 BA, 197.4
See application file for complete search history.

(56) References Cited

U.S. PATENT DOCUMENTS

| | | | | |
|---|---|---|---|---|
| 6,691,655 | B2 * | 2/2004 | Aoyama et al. | 123/90.16 |
| 2003/0051685 | A1 * | 3/2003 | Hiyoshi et al. | 123/78 E |
| 2003/0075125 | A1 | 4/2003 | Kreuter | |
| 2004/0012310 | A1 * | 1/2004 | Katakura et al. | 310/365 |
| 2009/0107454 | A1 * | 4/2009 | Hiyoshi et al. | 123/197.4 |

FOREIGN PATENT DOCUMENTS

| | | | |
|---|---|---|---|
| JP | 2005-30234 | A | 2/2005 |
| JP | 2005-214088 | A | 8/2005 |
| JP | 2006-189004 | A | 7/2006 |
| JP | 2007-247535 | A | 9/2007 |

* cited by examiner

*Primary Examiner* — Marguerite McMahon
(74) *Attorney, Agent, or Firm* — Morgan, Lewis & Bockius LLP

(57) ABSTRACT

Disclosed is a variable compression ratio control system configured to change a top dead center of a piston in an engine according to an operation state of the engine. The control system may include a motor provided as a power source, a control shaft coupled to the piston, wherein the control shaft changes the top dead center of the piston by a rotation of the control shaft, a driving shaft connected to the motor and to be rotated by the motor, an operation unit movable in a shaft direction of the driving shaft by a rotation of the driving shaft, and an operation link protruding from one portion of an exterior circumferential surface of the control shaft, wherein the operation unit is connected with the operation link so that the operation link rotates the control shaft while the operation unit moves in the shaft direction of the driving shaft.

9 Claims, 4 Drawing Sheets

VARIABLE COMPRESSION RATIO CONTROL SYSTEM

CROSS-REFERENCE TO RELATED APPLICATION

The present application claims priority of Korean Patent Application Number 10-2013-0019432 filed Feb. 22, 2013, the entire contents of which application are incorporated herein for all purposes by this reference.

BACKGROUND OF INVENTION

1. Field of Invention

The present invention relates to a variable compression ratio control system, and more particularly, to a variable compression ratio control system capable of stably controlling a variable compression ratio apparatus changing a compression ratio of mixed gas inside a combustion chamber according to an operation state of an engine.

2. Description of Related Art

In general, thermal efficiency of a heat engine is increased when a compression ratio is high. Here, the compression ratio is a ratio of a volume of gas, which flows in a cylinder, compressed by a piston, and is represented by "cylinder volume/combustion chamber volume at a top dead center of a piston". That is, as the top dead center of the piston becomes high, the compression ratio is increased.

In a case of a spark ignition engine, thermal efficiency may be increased by advance of an ignition timing, but there may be a limitation in the advance of the ignition timing considering abnormal combustion, and the like. Accordingly, a variable compression ratio (VCR) apparatus for improving thermal efficiency of the heat engine is demanded.

The variable compression ratio apparatus is an apparatus for changing a compression ratio of mixed gas according to an operation state of the engine. The variable compression ratio apparatus functions to improve fuel efficiency by improving a compression ratio of mixed gas under a low load condition of the engine, and prevent generation of knocking and improve output of an engine by decreasing the compression ratio of the mixed gas under a high load condition of the engine.

As a result of various experiments for a variable compression ratio apparatus in the related art, it is revealed that a change in a distance between a crank pin and a piston pin by using an eccentric bearing achieves high operational reliability. The eccentric bearing is connected with a control shaft by a plurality of links to be rotated so that the top dead center of the piston is changed according to the rotation of the control shaft.

In the meantime, a variable compression ratio control system is a system for controlling the rotation of the control shaft.

The variable compression ratio control system in the related art transmits torque of a motor to the control shaft by using a worm and a worm gear, which are formed to transmit a torque of one shaft to the other shaft between the one shaft and the other shaft disposed at a twisted position with respect to the position of the one shaft.

However, the worm and the worm gear have relatively larger back lash than other gear coupling, and an excessive noise and vibration may be generated due to the back lash. That is, firm gear-coupling of the worm and the worm gear is not easily secured, such that a self-locking function may be weak. Accordingly, driving of the motor for maintaining a position of the control shaft, as well as rotating the control shaft, is demanded. Further, the power transmission of the motor by the worm and the worm gear demands relatively large driving torque, compared to other gear coupling, so that there is a limitation in a decrease in a capacity of the motor.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide a variable compression ratio control system capable of minimizing back lash in gear coupling of a power transmission part.

Further, the present invention has been made in an effort to provide a variable compression ratio control system capable of decreasing driving torque of a motor required for rotating a control shaft.

Various aspects of the present invention provide a variable compression ratio control system for controlling a variable compression ratio apparatus configured to change a top dead center of a piston provided in an engine according to an operation state of the engine. The control system may include a motor provided as a power source, a control shaft coupled to the piston, wherein the control shaft changes the top dead center of the piston by a rotation of the control shaft, a driving shaft connected to the motor and to be rotated by the motor, an operation unit movable in a shaft direction of the driving shaft by a rotation of the driving shaft, and an operation link protruding from one portion of an exterior circumferential surface of the control shaft, wherein the operation unit is connected with the operation link so that the operation link rotates the control shaft while the operation unit moves in the shaft direction of the driving shaft.

A threaded screw may be formed in the exterior circumferential surface of the driving shaft, and the operation unit may be formed in a hollow pillar shape, and a threaded screw corresponding to the threaded screw of the driving shaft is formed in an interior circumferential surface of the operation unit to couple the driving shaft and the operation unit.

The variable compression ratio control system may further include a connection link having one end rotatably connected to the operation unit and the other end rotatably connected to the operation link so that the operation link rotates the control shaft while the operation unit moves in the shaft direction of the driving shaft.

The operation unit may move backward or forward in the shaft direction of the driving shaft according to a rotation direction of the driving shaft.

The variable compression ratio apparatus may include an eccentric bearing connecting a piston pin and a small end portion of a connecting rod to change the top dead center of the piston, wherein the top dead center of the piston is changed by a rotation of the eccentric bearing, and the control shaft may be provided with a control link protruding from another part of the exterior circumferential surface of the control shaft, wherein the control link is connected to the eccentric bearing by at least one link so that the eccentric bearing is rotated according to the rotation of the control shaft.

The operation link and the control link may be substantially perpendicular to the control shaft. The control shaft and the driving shaft may be disposed at an angle with respect to each other. The variable compression ratio control system may further include a control unit configured to control the motor. The control unit may be an electronic control unit.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
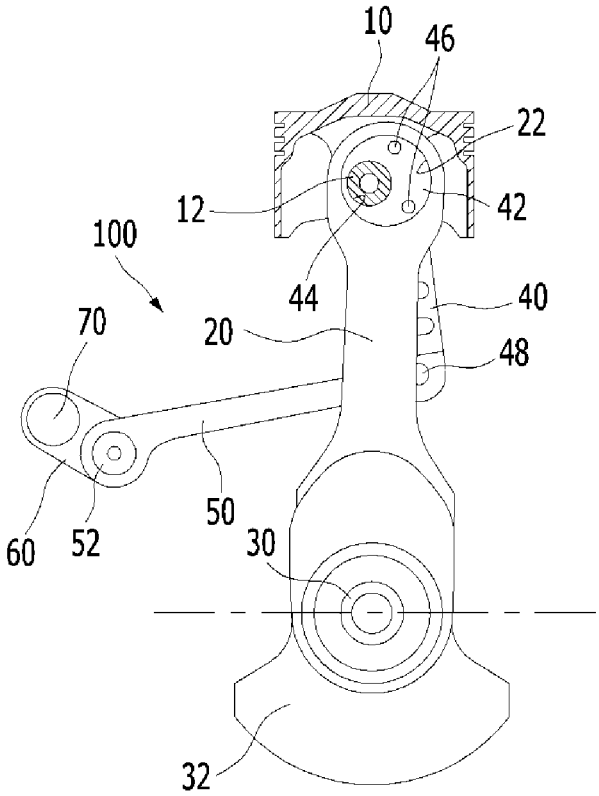
FIG. 1 is a diagram illustrating an exemplary variable compression ratio apparatus in a state where a top dead center of a piston moves up according to the present invention.
Figure 2:
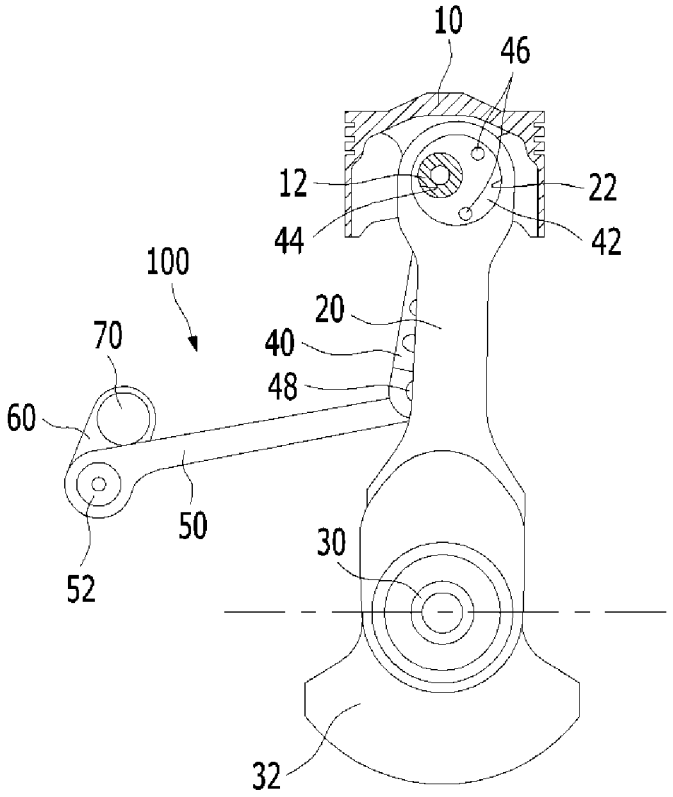
FIG. 2 is a diagram illustrating an exemplary variable compression ratio apparatus in a state where a top dead center of a piston moves down according to the present invention.

FIG. 1 is a diagram illustrating a state where a top dead center of a piston moves up according to an operation of a variable compression ratio apparatus and FIG. 2 is a diagram illustrating a state where a top dead center of a piston moves down according to an operation of a variable compression ratio apparatus according to various embodiments of the present invention.

FIGS. 1 and 2 illustrate a cross section of a piston 10 for graphically representing a configuration of a variable compression ratio apparatus 100. That is, the illustration of the piston 10 based on the cross section is for easily representing a configuration of a connection of the variable compression ratio apparatus 100 inside the piston 10.

As illustrated in FIGS. 1 and 2, the variable compression ratio apparatus according to the exemplary embodiment of the present invention is mounted in an engine for rotating a crank shaft 30 by receiving combustion force of mixed gas from the piston 10, and changes the mixing ratio according to an operation condition of the engine.

The piston 10 vertically or reciprocally moves inside a cylinder, and a combustion chamber is formed between the piston 10 and the cylinder.

The crankshaft 30 receives the combustion force from the piston 10, converts the received combustion force into torque, and transmits the torque to a transmission. The crankshaft 30 is mounted inside a crank case formed at a lower end of the cylinder. Further, a plurality of balance weights 32 is mounted in the crank shaft 30. The balance weight 32 decreases vibrations generated during a rotation of the crank shaft 30, and provides additional inertial force.

The configuration of the engine including the piston 10 and the crank shaft 30 is known, so a more detailed description will be omitted.

The variable compression ratio apparatus 100 according to various embodiments of the present invention includes a connecting rod 20, an eccentric link 40, an eccentric bearing 42, a variable link 50, a control link 60, and a control shaft 70.

The connecting rod 20 receives the combustion force from the piston 10 to transmit the received combustion force to the crank shaft 30. In order to transmit the combustion force, one end of the connecting rod 20 is rotatably connected to the piston 10 by a piston pin 12, and the other end of the connecting rod 20 is rotatably connected to the crank shaft 30. Further, the other end of the connecting rod 20 is eccentrically connected to one side of the crank shaft 30. In general, the one end portion of the connecting rod 20 connected with the piston 10 is referred to as a small end portion, and the other end portion of the connecting rod 20 connected with the crank shaft 30 is referred to as a large end portion.

The connecting rod 20 includes an eccentric bearing mounting hole 22. The eccentric bearing mounting hole 22 is substantially a circular hole formed at the small end portion of the connecting rod 20 so that the small end portion of the connecting rod 20 is rotatably connected with the piston 10.

An eccentric bearing 42 is provided at one end of the eccentric link 40. The eccentric link 40 and the eccentric bearing 42 may be coupled by coupling means 46, such as a pin, or may be integrally formed. Further, the eccentric bearing 42 is rotatably inserted in the eccentric bearing mounting hole 22 of the connecting rod 20, so that the eccentric link 40 is rotatably connected to a small end portion of the connecting rod 20. Further, the eccentric bearing 42 is formed substantially in a circular shape to correspond to the eccentric bearing mounting hole 22, and is concentrically inserted in the eccentric bearing mounting hole 22.

The eccentric bearing 42 includes a pin mounting hole 44. The pin mounting hole 44 is substantially a circular hole eccentrically formed with respect to the eccentric bearing 42. Further, the piston pin 12 is formed substantially in a circular shape to correspond to the pin mounting hole 44. Further, the piston pin 12 is inserted in the pin mounting hole 44, so that the eccentric bearing 42 is rotatably connected to the piston 10. Resultantly, the connecting rod 20 is rotatably connected to the piston 10.

Here, the eccentric link 40 and the eccentric bearing 42 are rotated based on a center of the eccentric bearing mounting hole 22, and are simultaneously rotated based on the center of the piston pin 12. In the meantime, the center of the piston pin 12 is spaced apart from the center of the eccentric bearing 42, which is concentric to the center of the eccentric bearing mounting hole 22, by a predetermined distance. Accordingly, a relative position of the piston pin 12 for the eccentric bearing mounting hole 22 is changed by the rotation of the eccentric link 40 and the eccentric bearing 42. That is, the relative position of the piston 10 for the connecting rod 20 and the crank shaft 30 is changed, and a compression ratio of mixed gas is ultimately changed.

The variable link 50 is operated so as to rotate the eccentric link 40 and the eccentric bearing 42. Further, an eccentric link connection part 48 is provided or formed at one end of the variable link 50. Further, one end of the variable link 50 is rotatably connected with the other end of the eccentric link 40 by the eccentric link connection part 48.

The control link 60 operates the variable link 50 so as to rotate the eccentric link 40 and the eccentric bearing 42.

Further, a variable link connection part 52 is provided or formed at one end of the control link 60. Further, one end of the control link 60 is rotatably connected with the other end of the variable link 50 by the variable link connection part 52.

The control shaft 70 is rotated together with the control link 60. That is, the control link 60 may be integrally and/or monolithically formed with the control shaft 70. Further, the control shaft 70 is disposed at the other end of the control link 60, and the control link 60 is rotated based on a shaft center of the control shaft 70.

FIG. 1 illustrates a state where the eccentric piston pin 12 is downwardly positioned inside the eccentric bearing mounting hole 22 so that the top dead center of the piston 10 goes down according to an operation of the control shaft 70, and FIG. 2 illustrates a state where the eccentric piston pin 12 is upwardly positioned inside the eccentric bearing mounting hole 22 so that the top dead center of the piston 10 goes up according to an operation of the control shaft 70.

As described above, the variable compression ratio apparatus 100 is operated so as to change the compression ratio of the mixed gas by changing the top dead center of the piston 10 according to the rotation of the control shaft 70. One would appreciate that the variable compression ratio apparatus 100 is one example and various alternatives, modifications or equivalents are within the scope of the present invention. One would also appreciate that the variable compression ratio control system 80 disclosed in the present invention is suitable to control the variable compression ratio apparatus 100 as well as various similar, alternative or other apparatuses to change the compression ratio of the mixed gas by controlling the rotation of the control shaft 70.

Figure 3:
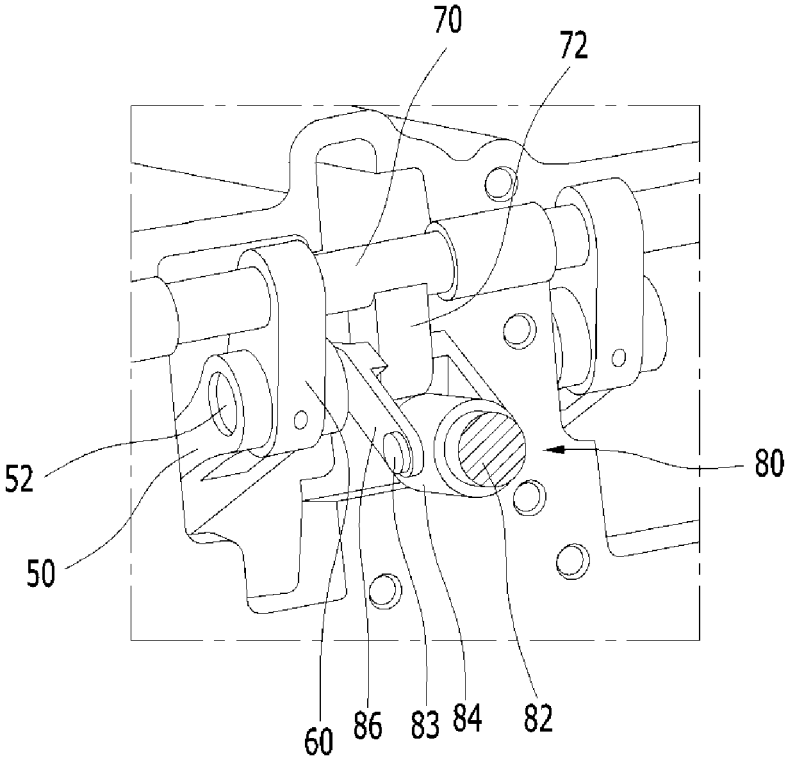
FIG. 3 is a diagram illustrating an exemplary connection between a variable compression ratio apparatus and a variable compression ratio control system according to the present invention.

FIG. 3 is a diagram illustrating a connection between the variable compression ratio apparatus and the variable compression ratio control system according to various embodiments of the present invention. As illustrated in FIG. 3, one or more of control links 60 may be formed in the control shaft 70. Further, the number of the control links 60 is in general the same as that of the cylinders of the engine. That is, one set of the constituent elements of the variable compression ratio apparatus 100 for connecting the control shaft 70 and the piston 10 so as to change the top dead center of the piston 10 disposed in every cylinder is provided for each cylinder. Further, an operation link 72 is formed in the control shaft 70.

The operation link 72 protrudes from one portion of an exterior circumferential surface of the control shaft 70. Further, the control link 60 connected with the variable link 50 protrudes from another portion of the exterior circumferential surface of the control shaft 70. Further, the operation link 72 and the control link 60 may be vertically disposed with respect to a shaft direction of the control shaft 70 or the operation link 72 and the control link 60 may be substantially perpendicular to the control shaft 70. Here, the variable compression ratio apparatus 100 and the variable compression ratio control system 80 are connected through the control shaft 70 in which the operation link 72 and the control link 60 are formed.

Figure 4:
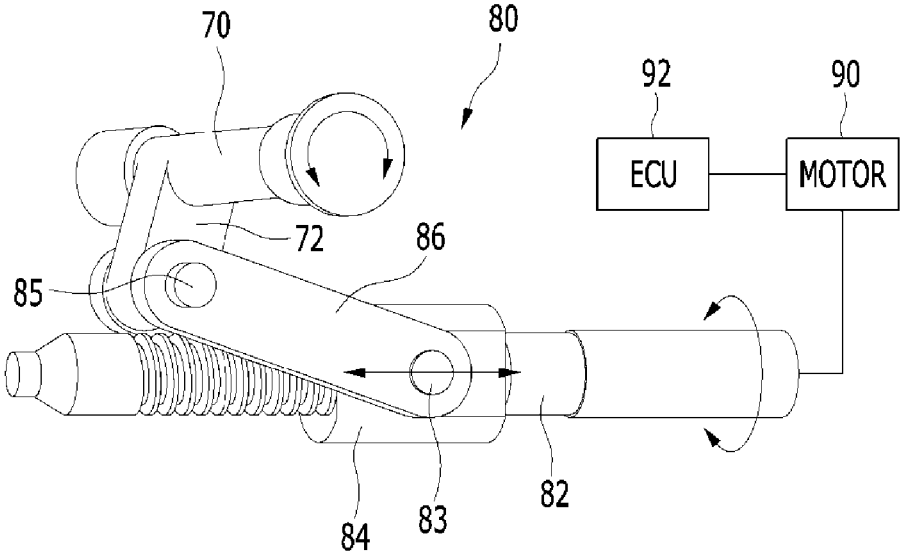
FIG. 4 is a schematic diagram illustrating an exemplary variable compression ratio control system according to the present invention.

FIG. 4 is a schematic diagram of the variable compression ratio control system according to various embodiments of the present invention. As illustrated in FIG. 4, the variable compression ratio control system 80 according to the exemplary embodiment of the present invention includes a motor 90, a control unit 92, a driving shaft 82, an operation unit 84, and a connection link 86.

The motor 90 is provided as a power source of the variable compression ratio control system 80. That is, the variable compression ratio control system 80 is operated by driving of the motor 90.

The control unit 92 controls the driving of the motor 90. Further, the control unit 92 may control a driving timing, a rotation direction, a rotating amount, and the like, of the motor 90. That is, the control unit 92 determines a compression ratio of the mixed gas according to the operation state of the engine. Further, the control unit 92 determines a rotation direction and a rotation angle of the control shaft 70, and drives the motor 90 according to the determined compression ratio. Here, the control unit 92 may be a general electronic control unit (ECU) generally controlling electronic devices of a vehicle.

The driving shaft 82 is rotated by the driving of the motor 90. Further, the driving shaft 82 may have a cylindrical shape rotating in a circumferential direction by the driving of the motor 90. Further, a threaded screw is formed in an exterior circumferential surface of the driving shaft 82.

The operation unit 84 is disposed so as to move in a shaft direction of the driving shaft 82 by the rotation of the driving shaft 82. Further, the operation unit 84 is formed in a pillar shape having a hollow opening. Further, the hollow opening is shaped substantially like a circular hole, and a threaded screw corresponding to the threaded screw of the driving shaft 82 is formed in an interior circumferential surface of the operation unit 84, which is an interior surface of the hollow opening.

The driving shaft 82 and the operation unit 84 are coupled by a method of coupling a bolt and a nut. That is, when the driving shaft 82 is rotated, the operation unit 84 is interworked by gear coupling of the threaded screws. Further, the operation unit 84 moves backward or forward in the shaft direction of the driving shaft 82 according to a rotation direction of the driving shaft 82 which is rotated by the motor 90. That is, the operation unit 84 may reciprocate in the shaft direction of the driving shaft 82.

The connection link 86 connects the operation unit 84 and the operation link 72. Further, one end of the connection link 86 is rotatably connected to the operation unit 84, and the other end of the connection link 86 is rotatably connected to the operation link 72 so that the operation link 72 rotates the control shaft 70 while interworking with the operation unit 84.

Here, one end of the connection link 86 is connected with the operation unit 84 by an operation unit connection part 83, and the operation unit connection part 83 may be formed in the operation unit 84 or the connection link 86, or may be an independently coupled circular pin. Further, the other end of the connection link 86 is connected with the operation link 72 by an operation link connection part 85, and the operation link connection unit 85 may be formed in the operation link 72 or the connection link 86, or may be in an independently coupled circular pin.

The operation link 72 and the operation unit 84 are connected by the connection link 86, so that the variable compression ratio control system 80 is operated so that the control shaft 70 rotates according to a linear movement of the operation unit 84.

The operation of the variable compression ratio control system 80 enables the driving shaft 82 and the control shaft 70, which are the two shafts positioned at the twisted position or positioned at an angle with respect to each other, to rotate while the driving shaft 82 interworks with the control shaft 70. In the meantime, the implementation of the interworking of the two shafts 70 and 80 at the angled or twisted position according to the operation of the variable compression ratio control system 80 relatively remarkably decreases back lash and requires small torque of the motor 90, compared to the worm and the worm gear mainly used for implementing the interworked rotation of the two shafts positioned at the twisted position.

As described above, according to the exemplary embodiment of the present invention, the driving shaft 82 and the operation unit 84 are gears coupled in a form in which the bolt is coupled with the nut, thereby minimizing the back lash. Accordingly, it is possible to minimize a noise and vibration due to the back lash. Further, it is possible to improve a self-locking function of the operation unit 84. Further, the operation unit 84 and the control shaft 70 are connected by the link, so that driving torque of the motor required for moving the operation unit 84 and rotating the control shaft 70 may be decreased. Accordingly, the motor 90 having the small capacity may be applied.

For convenience in explanation and accurate definition in the appended claims, the terms "upper" or "lower", "up" or "down", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio control system which controls a variable compression ratio apparatus configured to change a top dead center of a piston provided in an engine according to an operation state of the engine, the system comprising:

a motor provided as a power source;

a control shaft coupled to the piston, wherein the control shaft changes the top dead center of the piston by a rotation of the control shaft;

a driving shaft connected to the motor and to be rotated by the motor;

an operation unit movable in a shaft direction of the driving shaft by a rotation of the driving shaft; and an operation link protruding from one portion of an exterior circumferential surface of the control shaft, wherein the operation unit is connected with the operation link so that the operation link rotates the control shaft while the operation unit moves in the shaft direction of the driving shaft.

2. The variable compression ratio control system of claim 1, wherein:

a threaded screw is formed in an exterior circumferential surface of the driving shaft; and the operation unit is formed in a hollow pillar shape, and a threaded screw corresponding to the threaded screw of the driving shaft is formed in an interior circumferential surface of the operation unit to couple the driving shaft and the operation unit.

3. The variable compression ratio control system of claim 1, further comprising a connection link having one end rotatably connected to the operation unit and the other end rotatably connected to the operation link so that the operation link rotates the control shaft while the operation unit moves in the shaft direction of the driving shaft.

4. The variable compression ratio control system of claim 1, wherein the operation unit moves backward or forward in the shaft direction of the driving shaft according to a rotation direction of the driving shaft.

5. The variable compression ratio control system of claim 1, wherein:

the variable compression ratio apparatus includes an eccentric bearing connecting a piston pin and a small end portion of a connecting rod to change the top dead center of the piston, wherein the top dead center of the piston is changed by a rotation of the eccentric bearing; and the control shaft is provided with a control link protruding from another part of the exterior circumferential surface of the control shaft, wherein the control link is connected to the eccentric bearing by at least one link so that the eccentric bearing is rotated according to the rotation of the control shaft.

6. The variable compression ratio control system of claim 5, wherein the operation link and the control link are substantially perpendicular to the control shaft.

7. The variable compression ratio control system of claim 1, wherein the control shaft and the driving shaft are disposed at an angle with respect to each other.

8. The variable compression ratio control system of claim 1, further comprising a control unit configured to control the motor.

9. The variable compression ratio control system of claim 8, wherein the control unit comprises an electronic control unit.

* * * * *